United States Patent [19]

Kastle et al.

[11] Patent Number: 4,705,276

[45] Date of Patent: Nov. 10, 1987

[54] GAMEBOARD SWIVEL

[75] Inventors: George E. Kastle; Jennie R. Kastle, both of St. Petersburgh; Constance V. Stinedurf, Pinellas Park; James E. Wilson; Barbara M. Wilson, both of Homosassa Springs, all of Fla.

[73] Assignee: Swak, Inc., St. Petersburg, Fla.

[21] Appl. No.: 846,035

[22] Filed: Mar. 31, 1986

[51] Int. Cl.[4] ..... A63F 9/00

[52] U.S. Cl. ..... 273/309; 108/54.1; 108/65; 273/280

[58] Field of Search ..... 273/280, 309; 108/27, 108/54.1, 65, 66; 248/349

[56] References Cited

U.S. PATENT DOCUMENTS 4,378,943 4/1983 Newberry ..... 273/280

FOREIGN PATENT DOCUMENTS 524035 4/1955 Italy ..... 273/280

801642 9/1957 United Kingdom ..... 108/27

*Primary Examiner*—Anton O. Oechsle

*Attorney, Agent, or Firm*—Fleit, Jacobson, Cohn & Price

[57] ABSTRACT

A base is provided from which an overlying support is supported for angular displacement about an upstanding axis passing centrally through the support. A plurality of elongated coplanar support arms are disposed generally radially of and spaced equally about the axis and are mounted from the support for longitudinal extension and retraction of the arms relative to adjacent portions of the outer periphery of the support. The arms include outer end portions from which elongated gameboard marginal edge support members are mounted extending transversely of the arms and the support members include upwardly facing support surface portions spaced longitudinally therealong for support of a corresponding marginal portion of a gameboard therefrom. The support surface portions are generally coplanar with the upper surface of the horizontal support.

8 Claims, 3 Drawing Figures

GAMEBOARD SWIVEL

BACKGROUND OF THE INVENTION

1. Field of the Invention

This invention relates to a rotary support for a gameboard designed to support a gameboard of generally any plan shape in horizontal position and for angular displacement of the supported gameboard about an upstanding axis extending centrally therethrough. Structures of generally the same type may be classified in Classes 108, 248 and 273.

2. Description of Related Art

Various different forms of swivel bases, racks and other rotatable supports including some of the general structural and operational features of the instant invention are disclosed in U.S. Pat. Nos. 1,374,139, 2,113,386, 2,873,938, 2,914,793, 4,002,342 and 4,378,943.

However, these previously known devices do not include the overall structural and operational features of the instant invention which enable a gamboard of substantially any plan shape to be rotatably supported for angular displacement about an upstanding axis extending centrally through the gameboard, with the gameboard support being adjustable to accommodate gameboards of different sizes and with the gameboard support being operative to support the associated gameboard in an elevated position above a support surface.

SUMMARY OF THE INVENTION

The gameboard swivel of the instant invention includes a base for support from a suitable support surface and a horizontal support mounted from the base for angular displacement about an upstanding axis passing centrally through the support. The support includes a horizontal upper surface and an outer periphery which may be generally the same plan shape as the plan shape of a gameboard to be supported therefrom. A plurality of elongated coplanar support arms are supported from the support for longitudinal extension and retraction of the arms relative to adjacent portions of the outer periphery of the support along radii of the axis of rotation of the support relative to the base. The arms include outer end portions from which elongated transversely extending support members are supported and the support members include upwardly facing support surface portions spaced longitudinally therealong for support of a corresponding marginal portion of a gameboard therefrom. In addition, the support surface portions include outer upstanding inwardly facing boundary surface means spaced along the support members for opposing the marginal edge of the corresponding marginal portion of the supported gameboard. The support surface portions and the upper surface of the support are substantially coplanar and the transverse support members may be inwardly retracted toward positions with adjacent ends of adjacent support members at least substantially abutting each other and extending completely about the outer periphery of the horizontal support.

The main object of this invention is to provide a swivel support for a gameboard whereby an associated gameboard may be supported in horizontal position for angular displacement about an upstanding axis passing centrally through the gameboard.

Another object of this invention is to provide a gameboard swivel which may be adjusted to the size of a particular gameboard.

Still another important object of the invention is to provide a gameboard swivel which may be constructed for operative association in conjunction with gameboards having different plan shapes.

A further object of this invention is to provide a gameboard swivel operative to support an associated gameboard in elevated position relative to a support surface from which the swivel is supported.

A final object of this invention to be specifically enumerated herein is to provide a gameboard swivel in accordance with the preceding objects and which will conform to conventional forms of manufacture, be of simple construction and easy to use so as to provide a device that will be economical feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
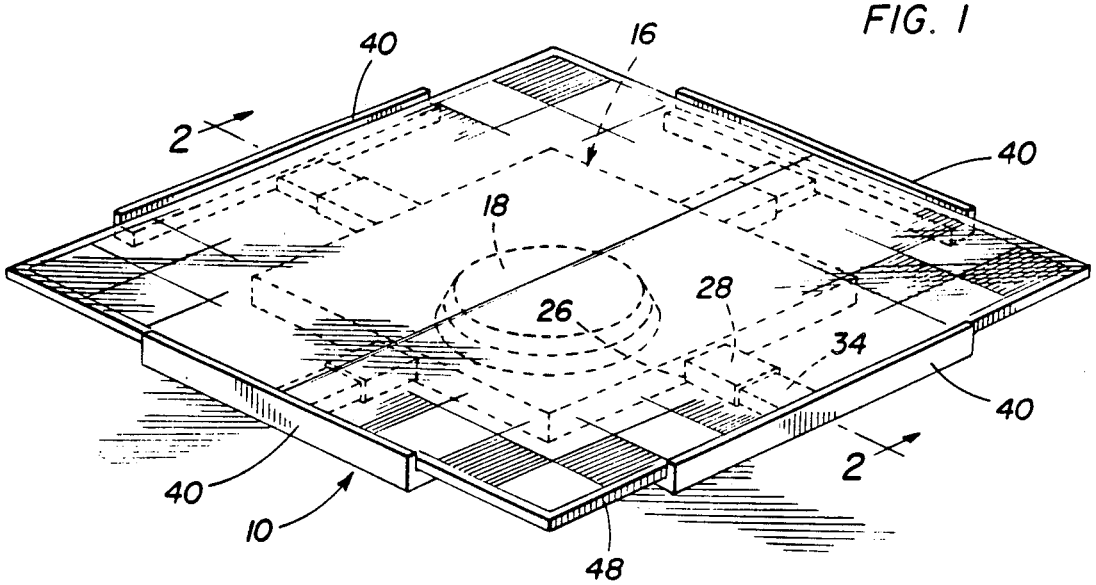
FIG. 1 is a perspective view of the gameboard swivel in its operative position supporting a rectangular gameboard therefrom.
Figure 2:
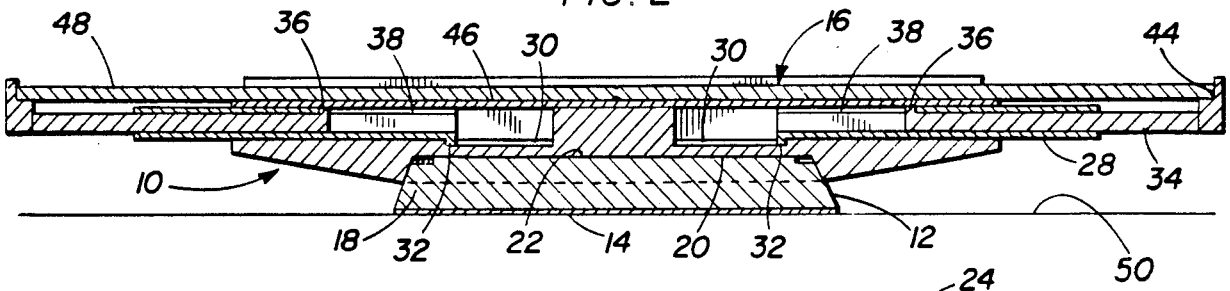
FIG. 2 is an enlarged vertical sectional view taken substantially upon the plane indicated by the section line 2—2 of FIG. 1.

Referring now more specifically to the drawings, the numeral 10 generally designates the gameboard swivel of the instant invention. The swivel 10 includes a frusto-conical base 12 including a cushioned pad 14 adhered to its undersurface and a horizontal support referred to in general by the reference numeral 16 and including a central downwardly opening frusto-conical recess 18 in which the upper portion of the base 12 is rotatably received, the recess including an upper end surface 20 which abuts the upper end surface 22 of the base 12 with the conical surfaces of the recess 18 and base 12 only slightly frictionally engaged with each other.

The support 16 is generally square in plan shape including four equal length marginal edges 24. The support 16 includes four outwardly opening sockets 26 of rectangular cross section which open outwardly through the edges 24 and include center lines disposed on equally angularly displaced radii of the coaxial center axes of the base 12 and recess 18.

The sockets 26 have tubular sleeves slidably disposed therein and each socket 26 includes an inner groove 30 formed therein in which a stop lug 32 formed on the corresponding sleeve 28 is slidably received. In addition, a rectangular cross section elongated support arm 34 is slidably disposed in each sleeve 28 and includes a stop lug 36 slidably received in a slot 38 formed in that sleeve. Accordingly, the stop lugs 32 limit outward movement of the sleeves 36 in the sockets 28 and the lugs 36 limit outward movement of the support arms 34 in the sleeves 26. The outer end of each support arm 34 includes an elongated curb member 40 supported therefrom including an upwardly facing longitudinal support surface 42 and an upstanding inwardly facing boundary surface 44.

Figure 3:
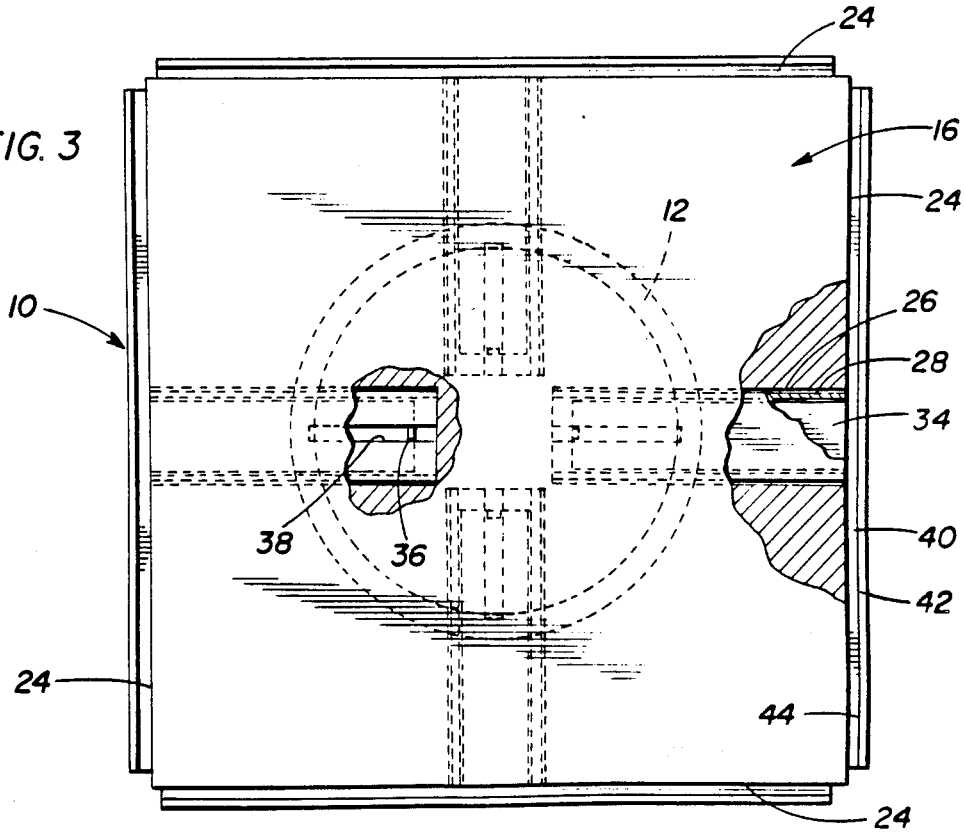
FIG. 3 is a top plan view of the invention with the extendible board outer periphery support arms in retracted positions and with portions of the swivel broken away and illustrated in horizontal section.

FIG. 3 illustrates the gameboard swivel 10 in a fully collapsed position with the curb members 40 fully retracted against the corresponding marginal edges 24 of the support 16. When in this position, the curb members 40 include adjacent ends which are only closely spaced apart. Furthermore, the support surfaces 42 are at least substantially coplanar with the upper surface 46 of the support 16.

When it is desired to support a square gameboard 48 from the support 10, the support arms 34 are disposed in their fully extended positions and the gameboard 48 is placed in centered position over the support 16 with the marginal edges of the gameboard 48 closely opposing the boundary surfaces 44. Assuming that the gameboard is a gameboard such as a Monopoly gameboard and that two or more persons playing the game are spaced about the board 48, it is possible that a player on one side of the board 48 may have to move his play piece or man along the other side of the board. In such instance, before that player throws the dice or otherwise starts his turn, the board 48 may be turned to a position with the side of the board 48 upon which his piece or man is disposed adjacent the player. In this manner, a plurality of game players may more comfortably play the game. Further, the support arms 34 are spaced sufficiently above the surface 50 upon which the gameboard support 10 rests to enable play money, playing cards and other game materials to be disposed in front of a player but beneath the marginal edges of the gameboard 48. Thus, a plurality of players may play a game on a table surface such as the surface 50 of considerably smaller dimensions than is required by a game such as Monopoly wherein space must be provided for game cards, game money and game property cards.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A swivel mount for a gameboard, said mount including a base, a horizontal support including an upper surface and an outer periphery and mounted on said base for angular displacement about an upstanding axis passing centrally through said support, a plurality of elongated coplanar support arms disposed generally radially of and spaced about said axis and mounted from said support for longitudinal extension and retraction of said arms relative to adjacent portions of said outer periphery, said arms including outer end portions from which elongated curb members are supported extending transversely of said arms, said curb members including upwardly facing support surface means spaced longitudinally along the curb members for support of a corresponding marginal portion of a gameboard therefrom and upstanding inwardly facing boundary surface means spaced along said curb members outwardly of said support surface means for opposing the marginal edge of said marginal portion, said support surface means being generally coplanar with said upper surfacae, said horizontal support including four horizontally outwardly opening sockets formed therein, disposed beneath said upper surface and in which said support arms are slidingly received, said sockets including center lines disposed on equally angularly spaced radii of said upstanding axis, said horizontal support being generally square in plan shape and said center lines bisecting corresponding outer peripheral sides of said horizontal support.

2. The swivel mount of claim 1 wherein said arms and support include coacting guide means operative to guide said arms against angular displacement thereof about the longitudinal axis relative to said support.

3. The swivel mount of claim 1 wherein said support and base include telescopingly engaged portions by which said horizontal support is mounted on said base for angular displacement about said upstanding axis.

4. The swivel mount of claim 1 where in each of said sockets includes a tubular sleeve slidably disposed therein, said support arms each being slidably received in a corresponding tubular sleeve.

5. A swivel mount for a gameboard, said swivel mount including a base, a horizontal support including an upper surface and an outer periphery and mounted on said base for angular displacement about an upstanding axis passing centrally through said support, a plurality of elongated coplanar support arms disposed generally radially of and spaced about said axis and mounted from said support for longitudinal extension and retraction of said arms relative to adjacent portions of said outer periphery, said arms including outer end portions from which elongated board marginal edge support members are supported extending transversely of said arms, said support members including upwardly facing support surface means spaced longitudinally along the support members for support of a corresponding marginal portion of a gameboard therefrom, said support surface means being generally coplanar with said upper surface, said horizontal support including four horizontally outwardly opening sockets formed therein, disposed beneath said upper surface and in which said support arms are slidingly received, said sockets including center lines disposed on equally angularly spaced radaii of said upstanding axis, said horizontal support being generally square in plan shape, said center lines bisecting corresponding outer peripheral sides of said horizontal support.

6. The swivel mount of claim 5 wherein said arms and support include coacting guide means operative to guide said arms against angular displacement thereof about the longitudinal axis relative to said support.

7. The swivel mount of claim 5 wherein said support and base include telescopingly engaged portions by which said horizontal support is mounted on said base for angular displacement about said upstanding axis.

8. The swivel mount of claim 5 wherein said arms equal four in number.

* * * * *